US005640924A

United States Patent [19]

Murrant

[11] Patent Number: 5,640,924

[45] Date of Patent: Jun. 24, 1997

[54] YACHT WITH TEMPORARY ENCLOSURE

[75] Inventor: Tom Murrant, Kidderminster, England

[73] Assignee: Global Yachts International, Inc., South Miami Beach, Fla.

[21] Appl. No.: 593,583

[22] Filed: Jan. 30, 1996

[51] Int. Cl.[6] ..... B63B 17/00

[52] U.S. Cl. ..... 114/361; 296/136

[58] Field of Search ..... 114/361; 135/88.01, 135/88.07, 88.13, 129; 296/136

[56] References Cited

U.S. PATENT DOCUMENTS 4,951,594 8/1990 Feikema ..... 114/361

*Primary Examiner*—Jesus D. Sotelo
*Attorney, Agent, or Firm*—William H. Eilberg

[57] ABSTRACT

An overhang roof of a yacht contains a compartment which stores a flexible canopy. The compartment includes upper and lower clamshell members, the lower clamshell member pivoting with respect to the upper member. When the lower clamshell member is unlatched and pivoted downward, the canopy is exposed, and it can be allowed to drop from the compartment and affixed to suitable parts of the yacht. The lower clamshell member can be closed and latched even when the canopy is hanging down from the compartment. The canopy thus forms a temporary enclosure for the rear deck portion of the yacht. The enclosure can be easily dismantled by returning the canopy to the compartment, and closing and latching the lower clamshell member.

16 Claims, 9 Drawing Sheets

YACHT WITH TEMPORARY ENCLOSURE

BACKGROUND OF THE INVENTION

This invention concerns an improvement for boats, especially yachts, and provides a convenient means of installing and dismantling a temporary enclosure around a portion of a deck.

It has been known to provide enclosures for yachts and other pleasure boats. Such enclosures typically comprise canopies made of clear plastic or the like. Installing an enclosure on a yacht makes it convenient for passengers to remain on the deck even in rainy conditions. An enclosure may also be useful when the yacht is moored. The enclosure can prevent the accumulation of dirt on the boat, and may even discourage unauthorized persons from entering the boat.

It has also been known to provide an overhang roof that extends from the bridge of the yacht. Such an overhang roof provides a shaded area for the passengers, and also provides a structure from which a flexible canopy can be suspended. An overhang roof of this kind is typically formed aft of the bridge, above the main deck.

A major disadvantage of flexible canopies is their inconvenience. A plastic or canvas canopy is unwieldy, and relatively heavy. It takes time to unfold it, and to suspend it from appropriate portions of the overhang roof. Suspending the canopy from the roof requires the use of unsightly fasteners, which can deteriorate after exposure to weather. It is even more inconvenient to fold the canopy again for storage, when the enclosure is to be dismantled. Moreover, storage space on any boat is limited, and the canopy must be stored in space that could otherwise be used to store other cargo.

The present invention provides an improvement which makes it possible to erect the desired flexible enclosure in a very short time, and which also makes it easy to store the enclosure when it is not in use. When stored according to the present invention, the enclosure is entirely hidden from view, and is protected from the weather. When in use, the enclosure of the present invention is aesthetically attractive, because it does not require unsightly fasteners.

SUMMARY OF THE INVENTION

According to the present invention, an overhang roof portion of a boat or yacht includes upper and lower clamshell members which together define a storage compartment. A flexible canopy is stored within this compartment. The lower clamshell member is downwardly pivotable with respect to the upper clamshell member. In the normal (closed) condition, the clamshell members are latched together. At least a portion of the canopy can be attached to hidden fastening devices, located within the compartment. When one desires to form an enclosure, one simply unlatches the lower clamshell member, and pivots this member to release the canopy stored in the compartment. One can easily pull the canopy down from the compartment. A portion of the canopy may be formed as separate side panels which are suspended from hoops or rods extending along a portion of the side of the overhang roof. Since the rear portion of the canopy always remains affixed to fasteners inside the compartment, one can easily set up the enclosure without a lengthy unfolding and attachment procedure.

The aft end of the lower clamshell member does not extend quite as far aft as the end of the upper clamshell member. Thus, when the lower clamshell returns to the closed position, there will still be a gap between the two clamshell members. This gap permits the canopy to hang straight down, even while the clamshell structure remains closed. Also, because the upper clamshell member overhangs the lower clamshell member, the arrangement does not allow water into the compartment. The bottom edges of the canopy may be attached to suitable structures on the deck or hull, to form a tight enclosure.

When one wants to dismantle the enclosure, one simply releases the attachments connecting the canopy to the deck or hull, opens the lower clamshell member, and stuffs the canopy into the compartment. At least a portion of the canopy always remains attached to fasteners within the compartment. One then closes the lower clamshell. Thus, the enclosure has been dismantled, and the canopy has been conveniently stored in the compartment formed in the overhang roof. The canopy does not occupy valuable storage space, because it remains in a space that would normally have gone unused.

In another aspect of the invention, the yacht includes a rear door, leading onto the main deck, under the overhang roof portion, the rear door being bowed such that the door curves forward, as one approaches the upper portion of the door. A curved staircase, leading from the main deck to the bridge, adjoins the bowed door. The staircase is therefore fully integrated with the door. This structure enhances the safety, comfort, and convenience of the yacht, because it allows the use of a wider staircase than would be possible with yachts of the prior art.

The present invention therefore has the primary object of providing a yacht having means for conveniently storing a canopy which forms a temporary deck enclosure.

The invention has the further object of providing a method for conveniently assembling and disassembling a temporary deck enclosure.

The invention has the further object of maximizing the utility of a yacht during times of bad weather, by making the deck comfortable for passengers at such times.

The invention has the further object of making better use of storage space available on a yacht, by providing a novel means of storing a canopy.

The invention has the further object of providing an integrated staircase and door for a yacht, to enhance the safety and convenience of a staircase connecting the main deck with the bridge.

The reader skilled in the art will recognize other objects and advantages of the present invention, from a reading of the following brief description of the drawings, the detailed description of the invention, and the appended claims.

DETAILED DESCRIPTION OF THE INVENTION

Figure 1:
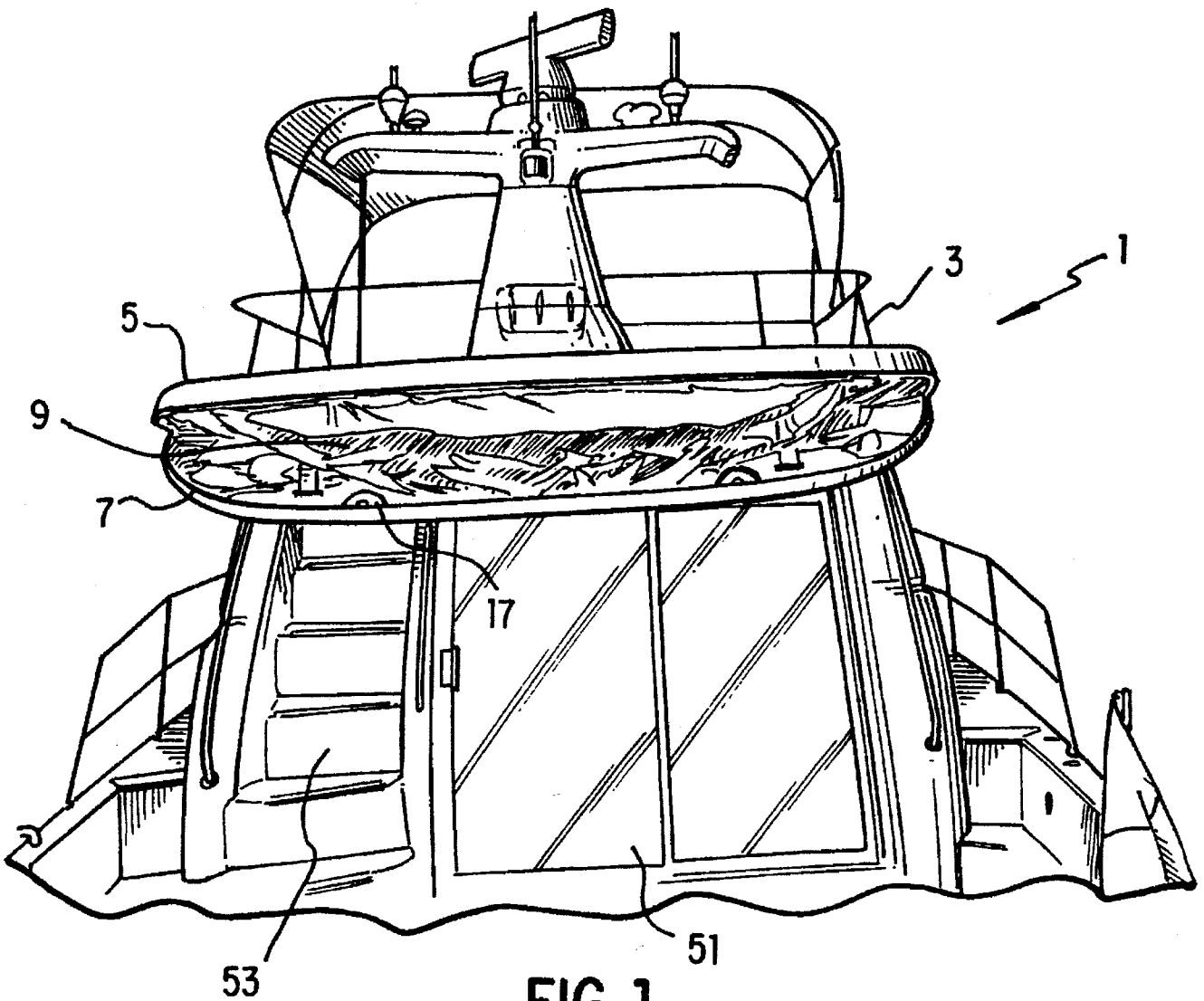
FIG. 1 provides a perspective view of the rear of a yacht made according to the present invention, showing the clamshell compartment slightly opened, and showing the canopy stored in the compartment.

FIG. 1 shows yacht 1 having bridge 3 and an overhang roof portion. The overhang roof portion has an extension which is connected to upper clamshell member 5 and lower clamshell member 7. Canopy 9 is stored within the compartment defined by members 5 and 7. The lower clamshell member pivots with respect to the upper clamshell member. The upper clamshell member does not move.

In the normal condition, the clamshell members define a closed compartment which stores the canopy 9. To close the compartment, one uses latches to secure the lower clamshell member in place. The latches include rods 21 (see FIGS. 7 and 8) which are received in latch members 23. The rods are actuated by knobs 13 (shown in FIG. 8) which sit in recesses 11. The recesses are defined by cup members 17, which are visible in FIGS. 1, 4, 7, and 9.

Figure 4:
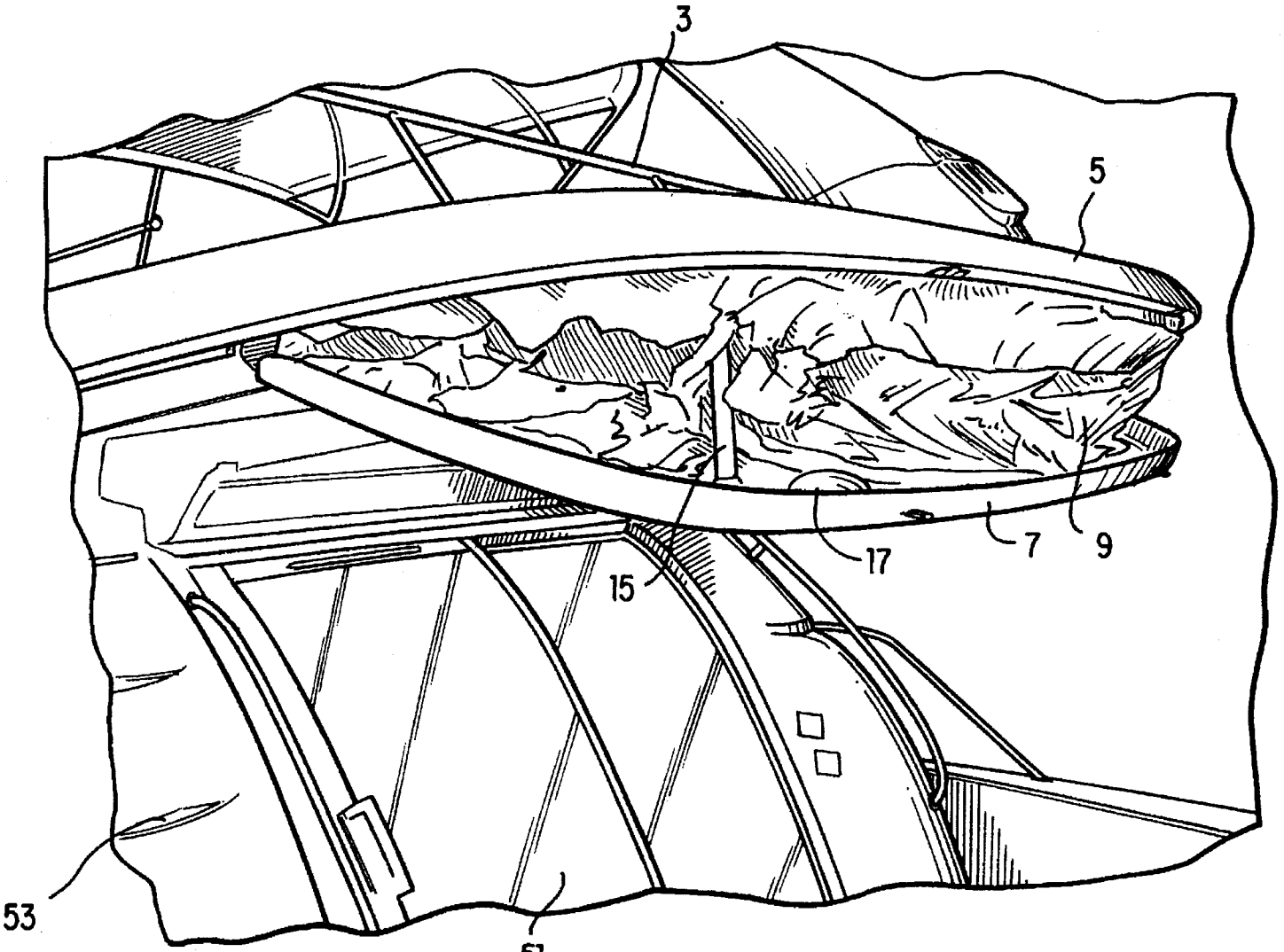
FIG. 4 provides a perspective view showing the clamshell compartment open, and showing the canopy stored within the compartment.
Figure 7:
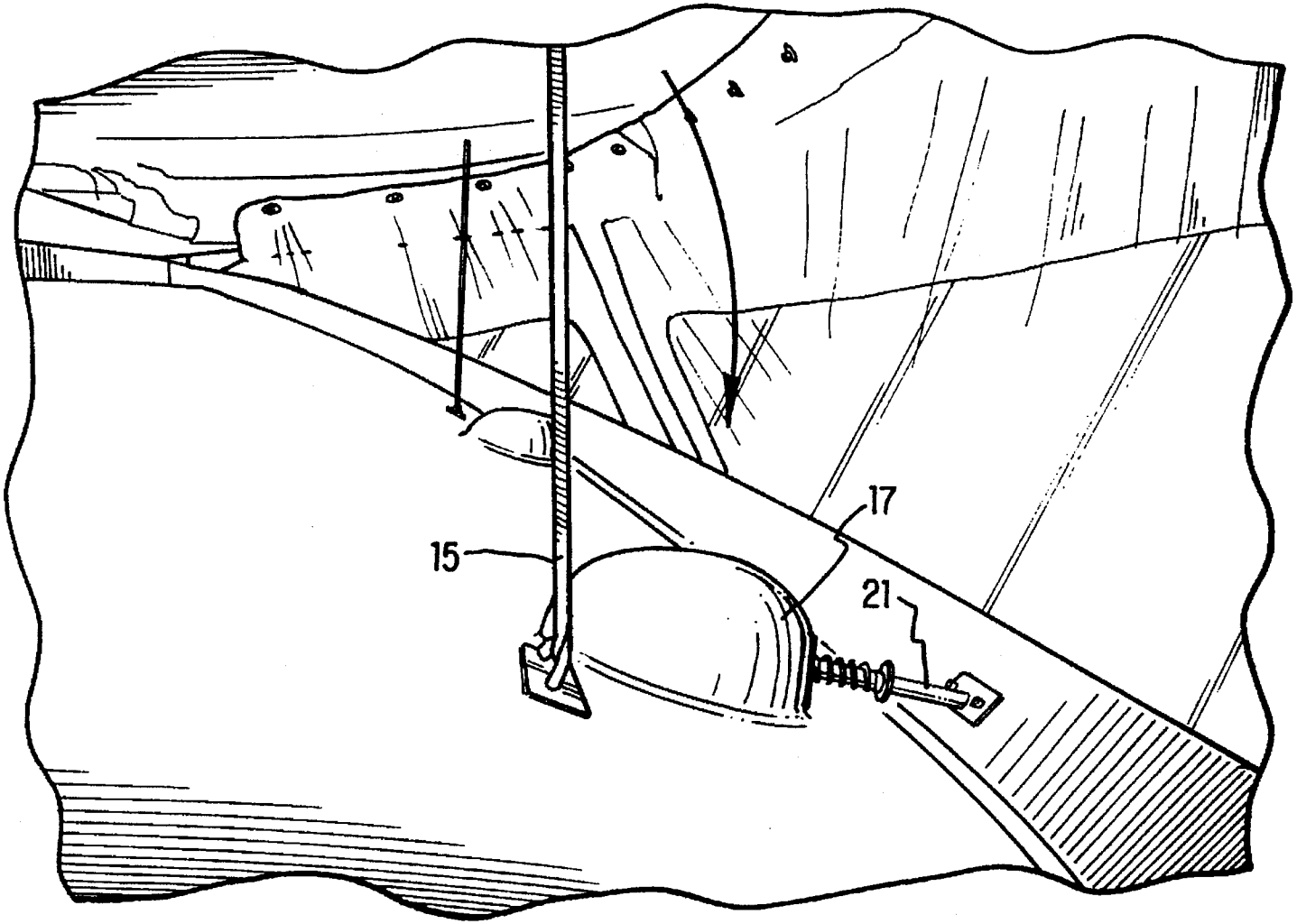
FIG. 7 provides a perspective view of the interior of the clamshell compartment, with the lower clamshell member in the open position, and with the canopy extended to form an enclosure.
Figure 8:
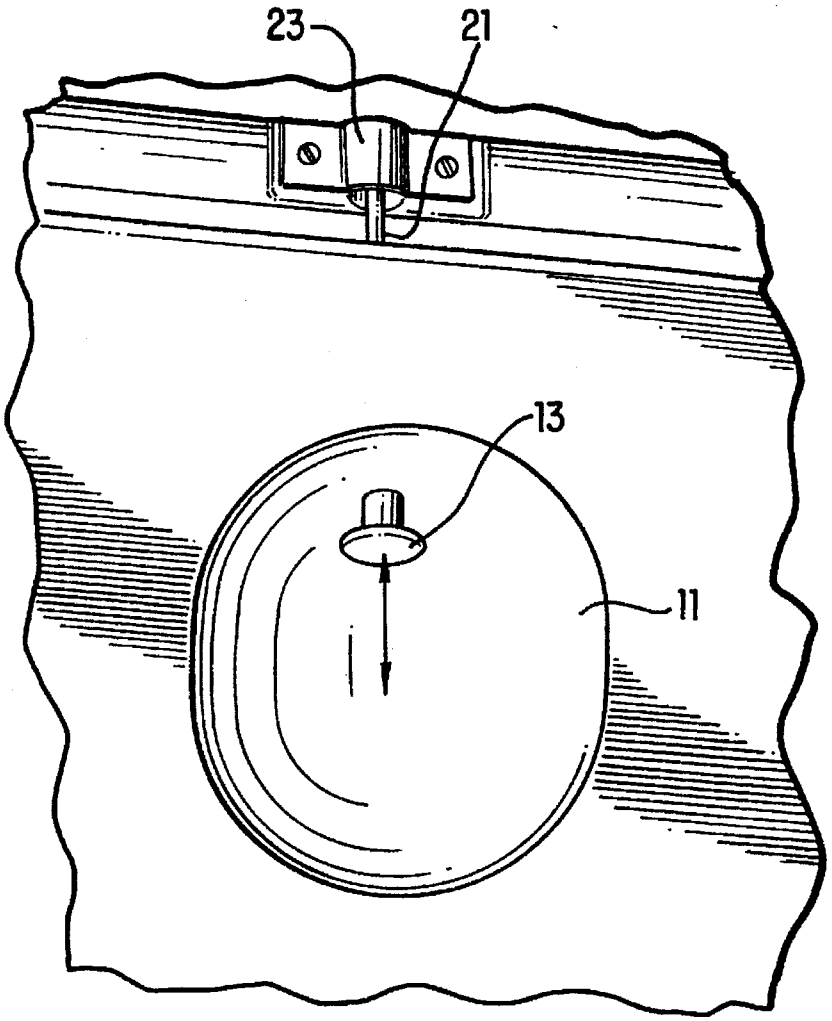
FIG. 8 provides a fragmentary perspective view of a fastening device for securing the clamshell compartment in the closed position.
Figure 9:
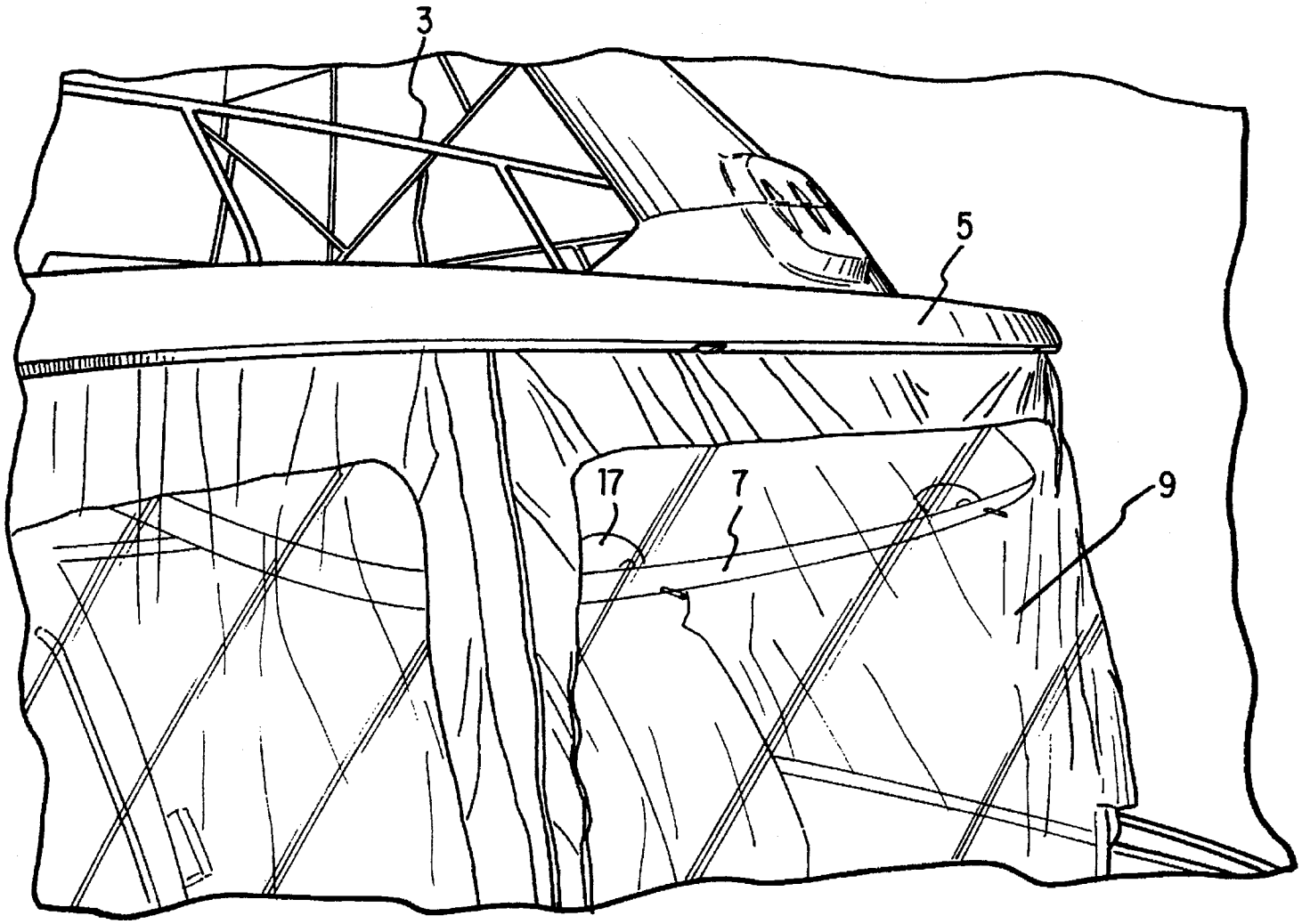
FIG. 9 provides a fragmentary perspective view showing the canopy extended, and also showing the lower clamshell member in the open position.

FIGS. 4 and 7 show straps 15, which limit the downward travel of the lower clamshell member, when that member is unlatched.

Figure 3:
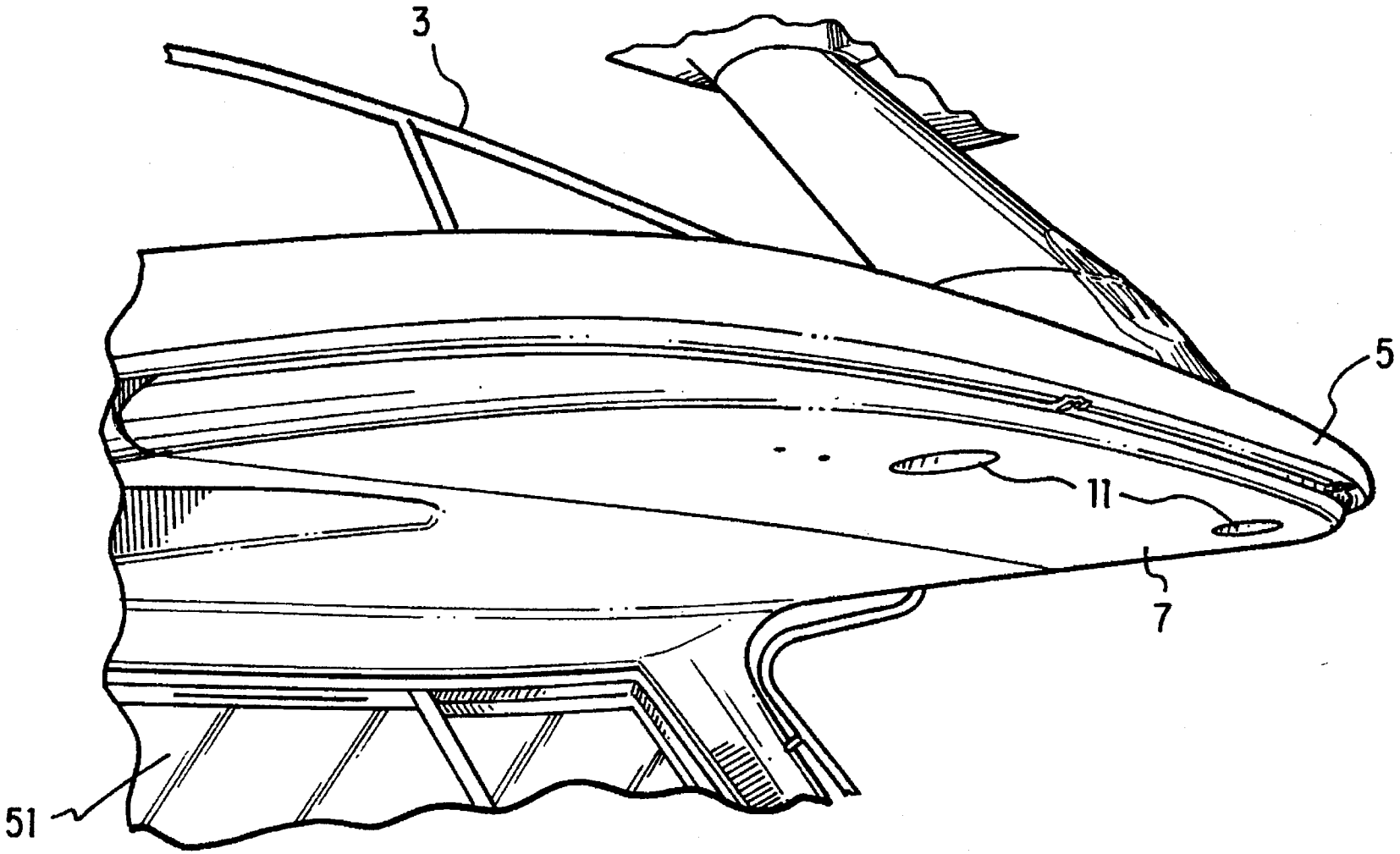
FIG. 3 provides a perspective view of the overhang roof of the yacht made according to the present invention, with the clamshell compartment closed.

As shown most clearly in FIG. 3, the lower clamshell member fits within the upper clamshell member, such that there remains a gap between these two members. The purpose of the gap is to allow the lower clamshell member to be closed when the canopy is still extended and is suspended from the overhang roof. The upper and lower clamshell members are analogous to a pair of jaws, the upper jaw overhanging the lower jaw. This overhanging arrangement insures that water will not enter the closed compartment, since the gap between the jaws is on the underside of the compartment.

The canopy is preferably formed as one rear panel and separate side panels. But other arrangements are also possible, and the invention is not limited to any one arrangement. In the preferred embodiment, where there is one rear panel and separate side panels, the rear panel is permanently affixed to fastening devices which are hidden within the compartment. The rear panel therefore can be easily dropped down when the compartment is opened. The side panels may be stored, in a folded condition, within the compartment, but without being affixed to any fasteners. The side panels may be attached to suitable hoops or rods, or the like, which hold the side panels in place. All of these alternatives are within the scope of the invention.

Figure 5:
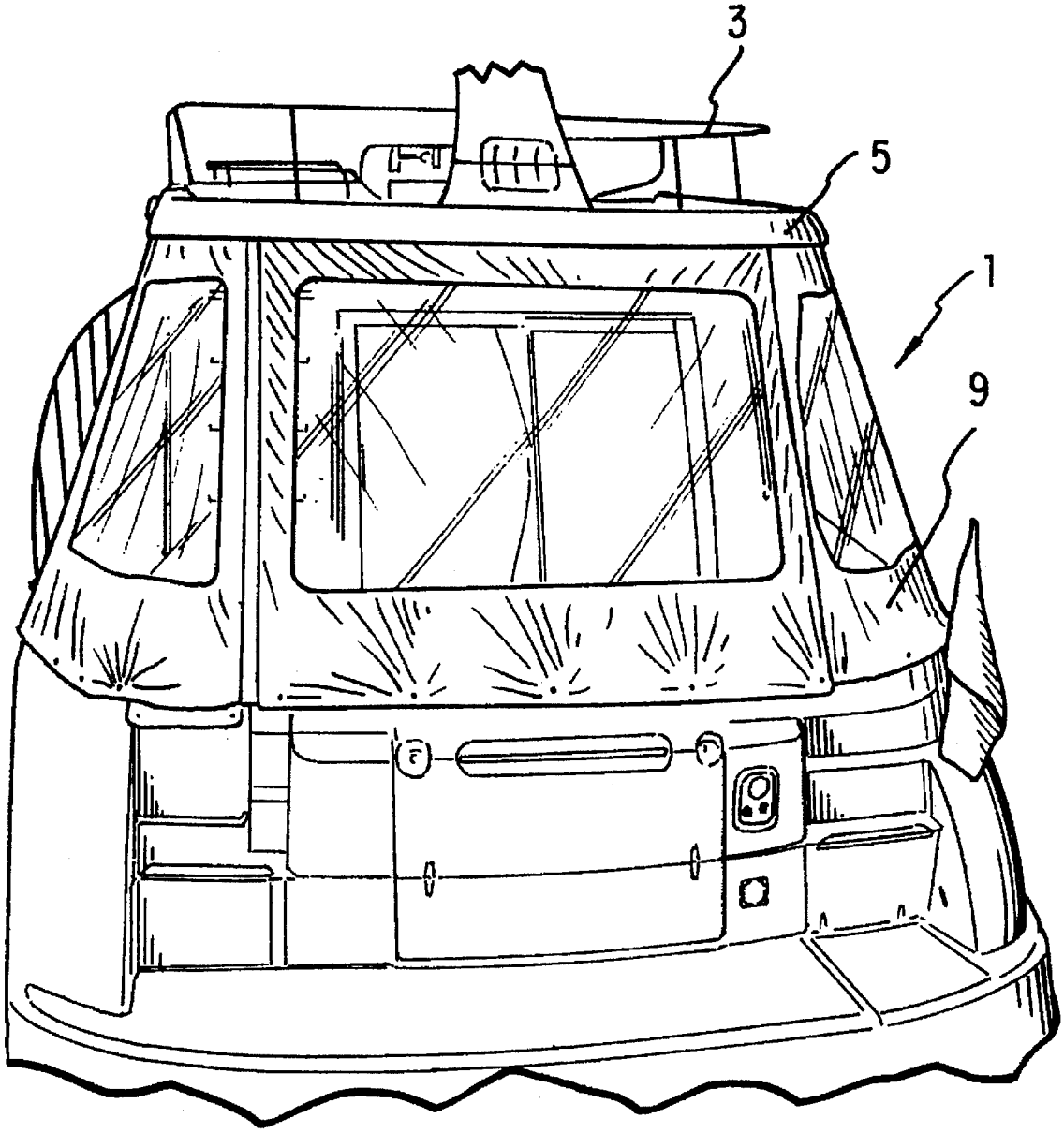
FIG. 5 provides a perspective view of the rear of a yacht made according to the invention, showing the canopy fully extended to form a temporary enclosure.
Figure 6:
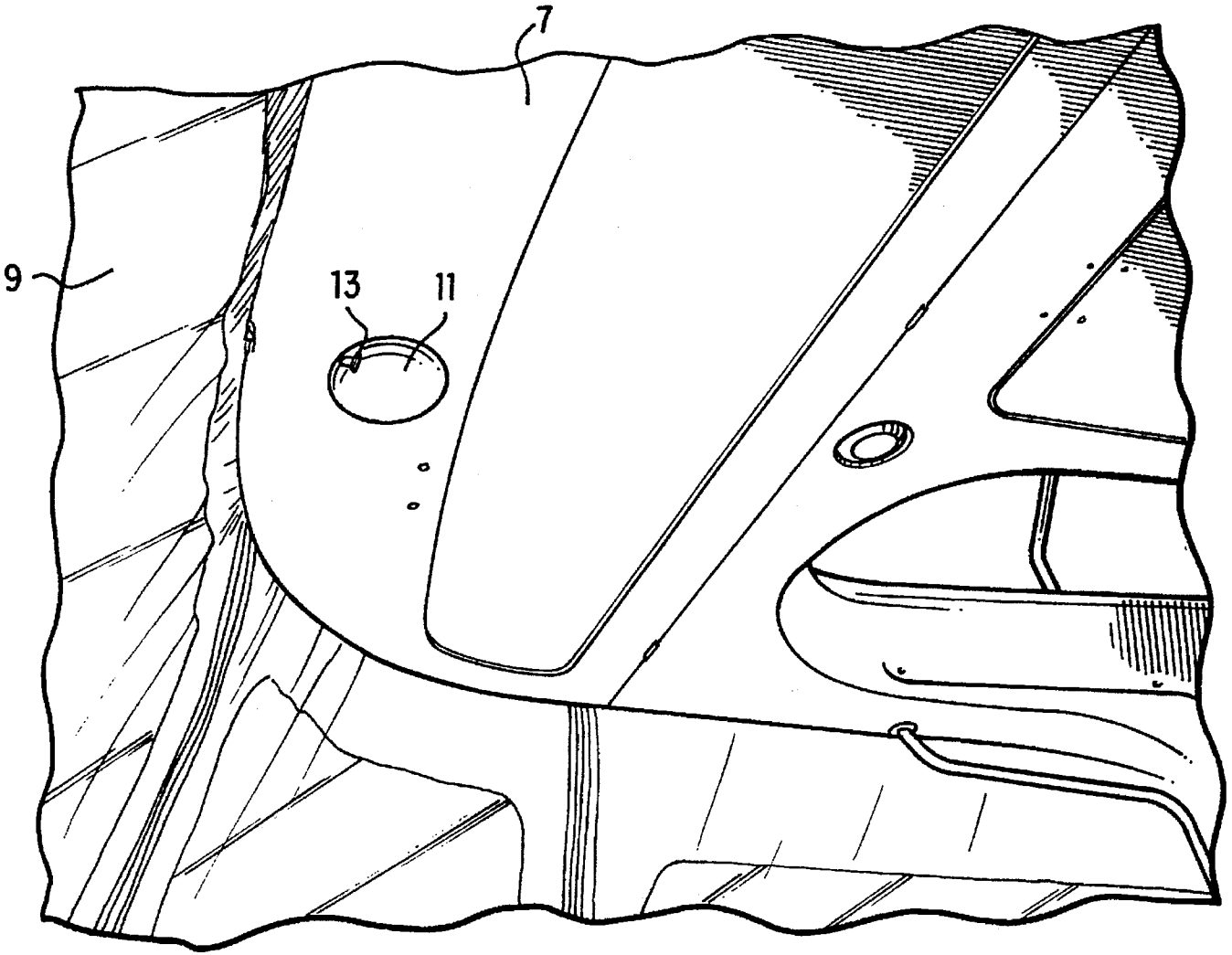
FIG. 6 provides a perspective view of the underside of the overhang roof, with the clamshell compartment closed, and with the canopy extended to form a temporary enclosure.

When the canopy is lowered, its bottom edges can be secured to appropriate attachment devices along the deck or hull of the yacht. For this purpose, one can provide holes and/or fasteners along the bottom edges of the canopy, so that the bottom of the canopy can be securely fastened, as illustrated in FIG. 5. Any means of fastening can be used, and all such means are within the scope of the present invention.

In using the present invention, one normally stores the canopy in the compartment defined by the clamshell members, with the lower clamshell member in the latched position. The overhang roof functions in the same manner as such structures in the prior art, except that it also serves to store the canopy when the canopy is not in use. When one desires to enclose the rear portion of the main deck, one unlatches the lower clamshell member, and allows that member to drop, thereby exposing the interior of the compartment.

One then assembles the enclosure. This step comprises allowing the rear portion of the canopy to drop down, and then fastening the bottom edges of the canopy to fasteners on the yacht, if desired. Then, one assembles the side panels to complete the enclosure. By keeping part of the canopy permanently attached to a fastening means within the compartment, one can substantially reduce the time necessary to set up the enclosure. The only effort required is in allowing the canopy to drop, fastening its bottom edges, and assembling the side panels.

When one wants to dismantle the enclosure, one simply unfastens the bottom edges of the canopy, removes the side panels, and returns all portions of the canopy to the compartment. One pushes the lower clamshell member upward, and latches it.

The present invention therefore makes better use of space than yachts of the prior art. With the present invention, one stores the canopy in a space which, in the prior art, would not be used. By making use of the space within the overhang roof, one frees other space for use in carrying other cargo.

The invention is not limited according to the means by which the canopy is stored within the compartment. For example, the rear portion of the canopy can be stored folded or it can be stored in a rolled condition. If in a rolled condition, one could simply turn a crank to extend or retract the panel. The invention is not limited to any particular means of folding the panels when they are stored.

Figure 2:
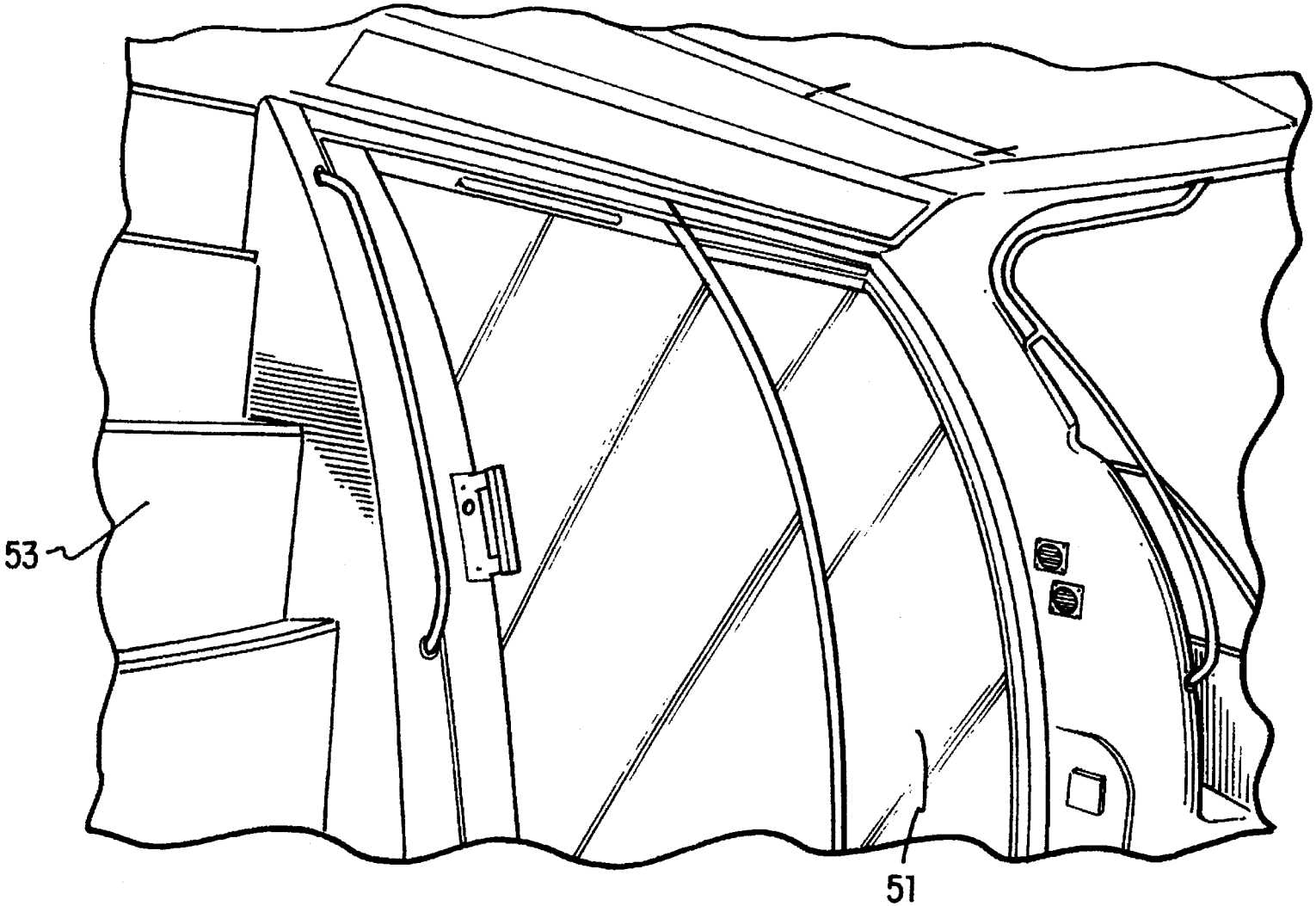
FIG. 2 provides a perspective view showing part of the underside of the overhang roof, and also showing the bowed door of the yacht made according to the present invention.

Another aspect of the invention includes the structure of the door and staircase adjoining the region beneath the overhang roof portion. The door has a bowed structure. FIGS. 2 and 4 show this feature most clearly. As shown in these figures, the door 51 comprises a two-piece sliding door, and bows forward as one proceeds upwardly. Also, staircase 53 (most clearly shown in FIG. 1) provides a convenient path between the main deck and the bridge, allowing passengers to go from the region beneath the overhang roof directly to the bridge. The staircase is curved such that, in the view of FIG. 1, as one proceeds up the staircase, the curvature is to the right. The curvature of the staircase is therefore defined by a radius of curvature which is perpendicular to the radius of curvature associated with door 51.

The arrangement described above has the advantage that it enhances the safety, convenience, and comfort of a staircase leading from the main deck to the bridge of a yacht. The staircase and curved door comprises an integrated structure, which makes it feasible to provide a staircase having a greater width than has been known in the prior art. A wider staircase is inherently safer and more comfortable.

In the embodiments described above, the yacht includes a bridge which supports the overhang roof. However, the invention is not limited to use in yachts having a bridge.

Some yachts contain abbreviated roof-like structures, erected on the main deck, which support radar antennas or the like, but which are not connected to a bridge per se. Such structures can also have the clamshell construction described above, and can store a canopy in the same manner. In general, any roof-like structure, whether supported by a bridge or erected on a main deck, can have the above-described clamshell structure. Thus, the term "overhang roof", as used in this specification, should be deemed to include any such roof structure, regardless of how it is mounted. The invention is not limited to a particular kind of roof-like structure.

While the invention has been described with respect to particular illustrated embodiments, the person skilled in the art will recognize further possible modifications. For example, the structure of the overhang roof, and the clamshell members, can be varied. Different means of affixing the canopy within the compartment, and to the main deck, can be used. All of the above-described modifications should be considered within the spirit and scope of the following claims.

What is claimed is:

1. In a boat, the boat having a main deck and a roof portion disposed over the main deck, the improvement wherein the roof portion comprises upper and lower clamshell members, the lower clamshell member being downwardly pivotable with respect to the upper clamshell member, and a flexible canopy stored between the upper and lower clamshell members, the canopy comprising means for forming an enclosure around at least part of the main deck.

2. The improvement of claim 1, further comprising means for latching the lower clamshell member relative to the upper clamshell member, wherein the upper and lower clamshell members together define a closed compartment.

3. The improvement of claim 1, further comprising means for limiting downward movement of the lower clamshell member.

4. The improvement of claim 1, wherein the lower clamshell member does not extend as far aft as the upper clamshell member, wherein there is a gap between the upper and lower clamshell members, wherein the gap comprises means for allowing the canopy to hang from the roof portion even while the lower clamshell member is in a full upward position.

5. The improvement of claim 1, wherein the upper and lower clamshell members together define a compartment, the compartment comprising means for storing the canopy.

6. The improvement of claim 1, wherein at least a portion of the canopy is affixed to fastening means within a compartment defined by the upper and lower clamshell members.

7. In a boat, the boat having a main deck and a roof portion disposed above the main deck, the roof portion being sufficiently long and sufficiently wide to comprise means for shielding occupants of the boat from sun and rain, the improvement wherein at least part of the roof portion defines a hollow compartment, wherein there is a canopy stored within the compartment, and wherein at least a portion of the compartment is openable to expose the canopy, and wherein the roof portion and the canopy together comprise means for forming an enclosure which includes the roof portion.

8. The improvement of claim 7, wherein the roof portion includes first and second clamshell members, wherein the first clamshell member pivots relative to the second clamshell member, wherein pivoting of the first clamshell member causes the compartment to be opened and closed.

9. The improvement of claim 8, wherein the clamshell members have ends which define a gap, wherein the canopy can extend through said gap when the compartment is closed.

10. A method of providing a temporary enclosure on a main deck of a boat, the method comprising the steps of:

a) storing a flexible canopy in an interior region of a roof portion, the roof portion comprising upper and lower clamshell members, the clamshell members being normally latched together so that the canopy is enclosed between said members, the canopy having an end which is affixed to at least one of the clamshell members, the canopy also having a free end, b) disengaging the lower clamshell member from the upper clamshell member, and pivoting the lower clamshell member away from the upper clamshell member, so as to expose the canopy, and c) withdrawing the free end of the canopy so as to create a temporary enclosure.

11. The method of claim 10, further comprising the step of affixing a bottom edge of the canopy to fastening means disposed on the boat.

12. The method of claim 10, further comprising the steps of returning the canopy to the interior region of the roof portion, pivoting the lower clamshell member towards the upper clamshell member, and latching the lower clamshell member.

13. In a boat, the boat having a main deck and a roof portion disposed above the main deck, the improvement wherein at least part of the roof portion defines a hollow compartment, wherein there is a canopy stored within the compartment, and wherein at least a portion of the compartment is openable to expose the canopy, wherein the roof portion includes first and second clamshell members, wherein the first clamshell member pivots relative to the second clamshell member, wherein pivoting of the first clamshell member causes the compartment to be opened and closed.

14. The improvement of claim 13, wherein the clamshell members have ends which define a gap, wherein the canopy can extend through said gap when the compartment is closed.

15. In a boat, the boat having a main deck and a roof portion disposed above the main deck, the improvement wherein at least part of the roof portion defines a hollow compartment, wherein there is a canopy stored within the compartment, and wherein at least a portion of the compartment is open to expose the canopy, wherein the roof portion includes first and second clamshell members, wherein the first clamshell member pivots relative to the second clamshell member, wherein pivoting of the first clamshell member causes the compartment to be opened and closed.

16. In a boat, the boat having a main deck and a roof portion disposed above the main deck, the roof portion being sufficiently long and sufficiently wide to comprise means for shielding occupants of the boat from sun and rain, the improvement wherein at least part of the roof portion defines a hollow compartment, wherein there is a canopy stored within the compartment, and wherein at least a portion of the compartment is open to expose the canopy, and wherein the roof portion and the canopy together comprise means for forming an enclosure which includes the roof portion.

* * * * *